US012691343B2

(12) United States Patent
Zhang

(10) Patent No.: US 12,691,343 B2
(45) Date of Patent: Jul. 28, 2026

(54) STAND LEG STRUCTURE OF GOLF BAG

(71) Applicant: Zujie Zhang, Dongguan (CN)

(72) Inventor: Zujie Zhang, Dongguan (CN)

( * ) Notice: Subject to any disclaimer, the term of this patent is extended or adjusted under 35 U.S.C. 154(b) by 0 days.

(21) Appl. No.: 18/782,623

(22) Filed: Jul. 24, 2024

(65) Prior Publication Data

US 2025/0032870 A1 Jan. 30, 2025

(30) Foreign Application Priority Data

Jul. 25, 2023 (CN) ..... 202321960231.8

(51) Int. Cl.
*A63B 55/57* (2015.01)

(52) U.S. Cl.
CPC ..... *A63B 55/57* (2015.10); *A63B 2209/08* (2013.01)

(58) Field of Classification Search
CPC ..... A63B 55/57; A63B 55/40; A63B 2209/08
USPC ..... 248/688, 96
See application file for complete search history.

(56) References Cited

U.S. PATENT DOCUMENTS 4,017,091 A * 4/1977 Wallen ..... A63B 55/60 280/DIG. 6
4,522,299 A * 6/1985 Clark ..... A63B 55/60 280/DIG. 6
5,478,097 A * 12/1995 Forma ..... A63B 55/60 280/DIG. 6
5,516,064 A * 5/1996 Hsieh ..... A63B 55/50 248/688
6,186,522 B1 * 2/2001 Weis ..... A45C 13/262 280/DIG. 6
6,435,345 B1 * 8/2002 Wang ..... A63B 55/57 206/315.7
6,766,905 B1 * 7/2004 Chang ..... A63B 55/53 206/315.6
6,988,738 B2 * 1/2006 Lu ..... B62B 5/067 280/DIG. 6
7,080,732 B2 * 7/2006 Bonfanti ..... A63B 55/60 280/DIG. 6
7,287,765 B2 * 10/2007 Murphy ..... B62B 3/12 206/315.3
7,303,070 B1 * 12/2007 Hong ..... A63B 55/30 206/315.6
7,549,534 B1 * 6/2009 Parpart ..... A63B 55/10 206/315.7
7,934,729 B2 * 5/2011 Murphy ..... A63B 55/60 280/DIG. 6
8,764,030 B1 * 7/2014 Murphy ..... A63B 55/60 280/DIG. 6
9,669,273 B2 * 6/2017 Lai ..... A63B 55/57
10,722,769 B1 * 7/2020 Kim ..... A63B 55/50
(Continued)

*Primary Examiner* — Nkeisha Smith
(74) *Attorney, Agent, or Firm* — Westbridge IP LLC

(57) ABSTRACT

A stand leg structure of a golf bag includes stand legs articulated with a top frame and steel wires articulated with the stand legs, and magnets are arranged in cavities of the stand legs. When the stand legs are folded, the magnets directly attract the steel wires, or the magnets attract an iron block on the steel wires, such that the stand legs can be stably folded on a bag body. Bottom ends of the stand legs are fitted with leg plugs, and the leg plugs seal the magnets in the cavities of the stand legs. When the stand legs are folded towards the bag body, the magnets directly attract the steel wires or attract the iron block on the steel wires, such that the stand legs can be stably folded on the bag body.

8 Claims, 2 Drawing Sheets

(56) References Cited

U.S. PATENT DOCUMENTS

| | | | | |
|---|---|---|---|---|
| 12,053,681 | B2 * | 8/2024 | Pacha | A63B 55/57 |
| 12,285,665 | B2 * | 4/2025 | Zhang | A63B 55/50 |
| 2003/0146602 | A1 * | 8/2003 | Lu | A63B 55/60<br>280/655 |
| 2004/0026279 | A1 * | 2/2004 | Miller | A63B 55/40<br>206/315.3 |
| 2008/0023356 | A1 * | 1/2008 | Manaster | A63B 55/00<br>206/315.3 |
| 2009/0212174 | A1 * | 8/2009 | Pratt | A63B 55/57<br>248/97 |
| 2019/0275393 | A1 * | 9/2019 | High | A63B 55/57 |
| 2022/0023727 | A1 * | 1/2022 | Pacha | A63B 55/57 |
| 2024/0207704 | A1 * | 6/2024 | Zhang | A63B 55/57 |
| 2024/0374971 | A1 * | 11/2024 | Pacha | A63B 55/40 |

* cited by examiner

STAND LEG STRUCTURE OF GOLF BAG

CROSS-REFERENCE TO RELATED APPLICATIONS

This application claims priority to Chinese Patent Application No. 202321960231.8, filed on Jul. 25, 2023, the content of which is incorporated herein by reference in its entirety.

TECHNICAL FIELD

The application relates to the field of leisure sporting goods, and particularly relates to golf bags.

BACKGROUND

A golf bag comprises a base, vertical rods, a top frame, stand legs and a bag body, wherein the vertical rods are inserted into the base, the top frame is mounted on the vertical rods, and the bag body is connected to the top frame and the base and wraps around the vertical rods. Top ends of the stand legs are articulated with the top frame, steel wires are articulated with the stand legs, bottom ends of the steel wires are connected to the base, and steel wire limiters are arranged on the bag body. The golf bag can be supported on a lawn by means of the stand legs, and when carrying the golf bag, users can fold the pair of stand legs to the bag body. When the golf bag is moved, for example, when users carry the golf bag on their back, the stand legs may swing away from and close to the bag body repeatedly due to the lack of a fixing device between the stand legs and the bag body, causing discomfort and inconvenience to users.

SUMMARY

The technical issue to be settled by the application is how to stably fold stand legs onto a bag body.

To settle the above technical issue, the application provides the following technical solution: a stand leg structure of a golf bag comprises stand legs articulated with a top frame and steel wires articulated with the stand legs, wherein magnets are arranged in cavities of the stand legs, and when the stand legs are folded towards a bag body, the magnets attract the steel wires; and bottom ends of the stand legs are fitted with leg plugs, and the leg plugs seal the magnets in the cavities of the stand legs.

An iron block is arranged on the steel wires, and when the stand legs are folded towards the bag body, the magnets attract the iron block to further attract the steel wires.

When the stand legs are folded towards the bag body, the magnets directly attract the steel wires or attract the iron block to further attract the steel wires, such that the stand legs can be stably folded on the bag body. When the golf bag is moved, the stand legs will not swing with respect to the bag body and thus will not cause discomfort or inconvenience to users.

Bottom ends of the stand legs are fitted with leg plugs, and the leg plugs seal the magnets in the cavities of the stand legs. The leg plugs are plastic members and are in interference fit with the cavities of the stand legs.

In the application, the magnets are sealed in the legs and can accurately attract the iron block, such that the production cost can be reduced.

The iron block comprises a mounting portion and wing portions located on two sides of the mounting portion, and the mounting portion is connected to the steel wires. The position of the iron block on the steel wires is fixed, such that when the stand legs are folded, the magnets and the iron block can be accurately attracted together.

Optionally, the mounting portion is detachably connected to the steel wires. The mounting portion is provided with wire slots and a notch, the steel wires penetrate through the wire slots, the notch divides a front wall of the mounting portion into a pair of connecting pieces, first connecting holes are formed in the connecting pieces, and second connecting holes corresponding to the first connecting holes are formed in a back wall of the mounting portion. Connecting members are fitted in the first connecting holes and the second connecting holes to enable the connecting pieces to move towards the back wall to clamp the pair of steel wires together with the back wall, such that the pair of steel wires are connected to the mounting portion and then connected to the iron block.

Optionally, the mounting portion is fixedly connected to the steel wires. Different from the detachable connection, the fixed connection may be that the mounting portion is welded on the steel wires, or the mounting portion is riveted to the steel wires, or the mounting portion is directly pressed on the steel wires.

Dents are arranged on the stand legs, and the dents are located above the magnets and are concaved inwards. The dents may be formed by an external pressing device or fixture, and are configured to restrain the magnets from moving upward along the cavities of the stand legs, such that the positions of the magnets in the stand legs are fixed, and the magnets and the iron block can be accurately attracted together.

BRIEF DESCRIPTION OF THE DRAWINGS

The application will be further described below in conjunction with accompanying drawings.

DETAILED DESCRIPTION OF THE EMBODIMENTS

Embodiment 1

Figure 1:
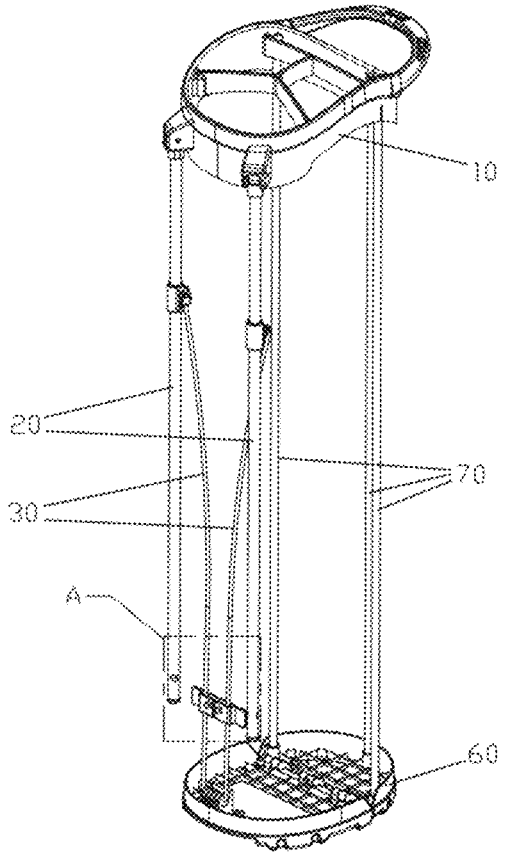
FIG. 1 is a schematic diagram of a frame of a golf bag.
Figure 2:
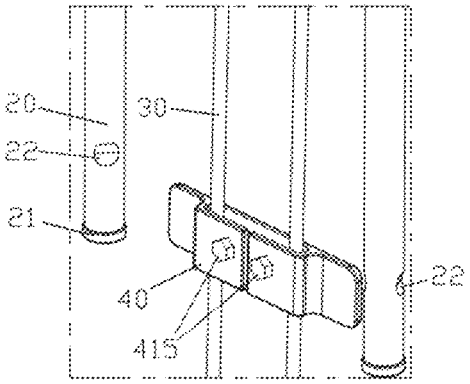
FIG. 2 is an enlarged view of part A in FIG. 1.
Figure 3:
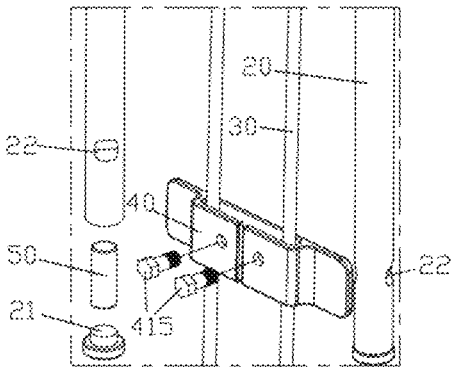
FIG. 3 is a partial exploded structural view of FIG. 2.

Referring to FIG. 1-FIG. 3, a stand leg structure of a golf bag comprises stand legs 20 articulated with a top frame 10 and steel wires 30 articulated with the stand legs, wherein an iron block 40 is arranged on the steel wires, magnets 50 are arranged in cavities of the stand legs, and when the stand legs are folded towards a bag body, the magnets attract the iron block.

When the stand legs 20 are folded towards the bag body, the magnets 50 draw close to the iron block 40 and attract the iron block, such that the stand legs 20 can be stably folded onto the bag body. When the golf bag is moved, for example, when users carry the golf bag on their back, the stand legs 20 will not swing with respect to the bag body and thus will not cause discomfort or inconvenience to users.

As show in FIG. 3, bottom ends of the stand legs 20 are fitted with leg plugs 21, and the leg plugs seal the magnets 50 in the cavities of the stand legs. The leg plugs are plastic members and are in interference fit with the cavities of the stand legs 20.

Figure 4:
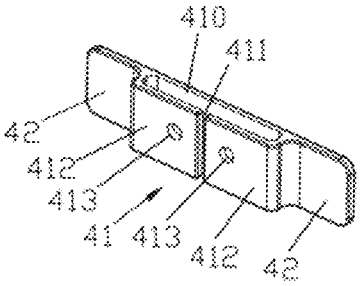
FIG. 4 is a schematic diagram of an iron block in FIG. 3.
Figure 5:
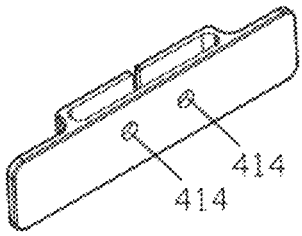
FIG. 5 is a schematic diagram of the iron block in FIG. 4, from another perspective.

Also referring to FIG. 4 and FIG. 5, the iron block 40 comprises a mounting portion 41 and wing portions 42 located on two sides of the mounting portion, wherein the mounting portion 41 is connected to the steel wires 30, such that the position of the iron block 40 on the steel wires 30 is fixed. When the pair of stand legs 20 are folded, the magnets 50 in the pair of stand legs 20 and the pair of wing portions 42 of the iron block 40 are accurately attracted together.

Referring to FIG. 2 and FIG. 3, the mounting portion 41 is detachably connected to the steel wires 30. The mounting portion 41 is provided with wire slots 410 and a notch 411, wherein the wire slots are connected with the notch. The mounting portion 41 with the wire slots 410 is frame-shaped and comprises a front wall, a back wall, a left wall and a right wall. The pair of steel wires 30 penetrate through the wire slots 410, the notch 411 divides the front wall of mounting portion 41 into a pair of connecting pieces 412, first connecting holes 413 are formed in the connecting pieces, and second connecting holes 414 corresponding to the first connecting holes are formed in the back wall of the mounting portion. Connecting members 415 are fitted in the first connecting holes 413 and the second connecting holes 414 to enable the pair of connecting pieces 412 to move towards the back wall to clamp the pair of steel wires 30 together with the back wall, such that the pair of steel wires 30 are connected to the mounting portion 41 and then connected to the iron block 40.

Dents 22 are arranged on the stand legs 20, and the dents 22 are located above the magnets 50 and are concaved inwards. The dents 22 may be formed by an external pressing device or fixture, and are configured to restrain the magnets from moving upward along the cavities of the stand legs, such that the positions of the magnets in the stand legs are fixed, and the magnets 20 and the iron block 40 can be accurately attracted together.

Embodiment 2

Referring to FIG. 1-FIG. 3, a stand leg structure of a golf bag comprises stand legs 20 articulated with a top frame 10 and steel wires 30 articulated with the stand legs, wherein an iron block is arranged on the steel wires, magnets 50 are arranged in cavities of the stand legs, and when the stand legs are folded towards a bag body, the magnets attract the iron block.

When the stand legs 20 are folded towards the bag body, the magnets draw close to the iron block and attract the iron block, such that the stand legs 20 can be stably folded onto the bag body. When the golf bag is moved, for example, when users carry the golf bag on their back, the stand legs 20 will not swing with respect to the bag body and thus will not cause discomfort or inconvenience to users.

Bottom ends of the stand legs 20 are fitted with leg plugs 21, and the leg plugs seal the magnets 50 in the cavities of the stand legs. The leg plugs are plastic members and are in interference fit with the cavities of the stand legs 20.

Dents 22 are arranged on the stand legs 20, and the dents 22 are located above the magnets 50 and are concaved inwards. The dents 22 may be formed by an external pressing device or fixture, and are configured to restrain the magnets from moving upwards along the cavities of the stand legs, such that the positions of the magnets in the stand legs are fixed, and the magnets 20 and the iron block 40 can be accurately attracted together.

The iron block comprises a mounting portion and wing portions located on two sides of the mounting portion, wherein the mounting portion is fixedly connected to the steel wires 30. Different from the detachable connection, the fixed connection may be that the mounting portion is welded on the steel wires 30, or the mounting portion is riveted to the steel wires 30, or the mounting portion is directly pressed on the steel wires 30.

The position of the iron block on the steel wires is fixed, such that when the stand legs are folded, the magnets and the iron block can be accurately attracted together.

Embodiment 3

Figure 6:
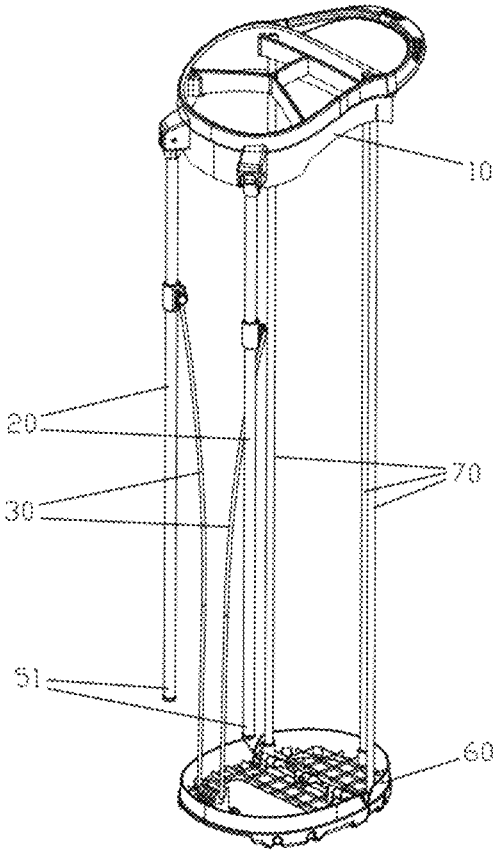
FIG. 6 is a schematic diagram of the frame of the golf bag, wherein the iron block is not arranged on steel wires, and magnets in stand legs directly attract the steel wires.

Referring to FIG. 6, a stand leg structure of a golf bag comprises stand legs 20 articulated with a top frame 10 and steel wires 30 articulated with the stand legs, wherein magnets 50 are arranged in cavities of the stand legs, and when the stand legs are folded towards a bag body, the magnets directly attract the steel wires 30.

When the stand legs 20 are folded towards the bag body, the magnets 50 draw close to the steel wires 30 and attract the steel wires 30, such that the stand legs 20 can be stably folded onto the bag body. When the golf bag is moved, for example, when users carry the golf bag on their back, the stand legs 20 will not swing with respect to the bag body and thus will not cause discomfort or inconvenience to users.

Bottom ends of the stand legs 20 are fitted with leg plugs 21, and the leg plugs seal the magnets 50 in the cavities of the stand legs. The leg plugs are plastic members and are in interference fit with the cavities of the stand legs 20.

Dents 22 are arranged on the stand legs 20, and the dents 22 are located above the magnets 50 and are concaved inwards. The dents 22 may be formed by an external pressing device or fixture, and are configured to restrain the magnets from moving upwards along the cavities of the stand legs, such that the positions of the magnets in the stand legs are fixed.

The above embodiments are merely preferred ones of the invention. For those ordinarily skilled in the art, the specific embodiments and application range of the invention may be changed according to the concept of the invention. The contents in the specification should not be construed as limitations of the invention.

What is claimed is:

1. A stand leg structure of a golf bag, comprising stand legs articulated with a top frame and steel wires articulated with the stand legs, wherein magnets are arranged in cavities of the stand legs, and when the stand legs are folded towards a bag body, the magnets attract the steel wires; and bottom ends of the stand legs are fitted with leg plugs, and the leg plugs seal the magnets in the cavities of the stand legs; and dents are arranged on the stand legs, and the dents are located above the magnets and are concaved inwards to retrain the magnets from moving upwards along the cavities of the stand legs.

2. The stand leg structure of the golf bag according to claim 1, wherein an iron block is arranged on the steel wires, and when the stand legs are folded towards the bag body, the magnets attract the iron block to further attract the steel wires.

3. The stand leg structure of the golf bag according to claim 2, wherein the iron block comprises a mounting portion and wing portions located on two sides of the mounting portion, and the mounting portion is connected to the steel wires.

4. The stand leg structure of the golf bag according to claim 3, wherein the mounting portion is provided with wire slots and a notch, the wire slots are connected with the notch, and the mounting portion comprises a front wall, a back wall, a left wall and a right wall.

5. The stand leg structure of the golf bag according to claim 4, wherein a pair of steel wires penetrate through the wire slots, the notch divides the front wall of the mounting portion into a pair of connecting pieces, first connecting holes are formed in the connecting pieces, and second connecting holes corresponding to the first connecting holes are formed in the back wall of the mounting portion.

6. The stand leg structure of the golf bag according to claim 5, wherein connecting members are fitted in the first connecting holes and the second connecting holes to enable the pair of connecting pieces to move towards the back wall to clamp the pair of steel wires together with the back wall, such that the pair of steel wires are connected to the mounting portion and then connected to the iron block.

7. The stand leg structure of the golf bag according to claim 3, wherein the mounting portion is detachably connected to the steel wires.

8. The stand leg structure of the golf bag according to claim 3, wherein the mounting portion is fixedly connected to the steel wires.

* * * * *